US007481712B2

(12) United States Patent
McBrien

(10) Patent No.: US 7,481,712 B2
(45) Date of Patent: Jan. 27, 2009

(54) SKI MAT AND TILE MEMBER FOR FORMING THE SKI MAT

(76) Inventor: Kent D. McBrien, 3278 E. Prospect Rd., York, PA (US) 17402

( * ) Notice: Subject to any disclaimer, the term of this patent is extended or adjusted under 35 U.S.C. 154(b) by 352 days.

(21) Appl. No.: 11/458,170

(22) Filed: Jul. 18, 2006

(65) Prior Publication Data

US 2008/0020852 A1 Jan. 24, 2008

(51) Int. Cl.
*A63C 19/10* (2006.01)

(52) U.S. Cl. ..... 472/90; 472/92

(58) Field of Classification Search ..... 472/88, 472/90, 136, 137; 428/15, 58
See application file for complete search history.

(56) References Cited

U.S. PATENT DOCUMENTS

| | | | | | |
|---|---|---|---|---|---|
| 863,054 | A | * | 8/1907 | Dickerson | 15/215 |
| 2,174,716 | A | * | 10/1939 | Bethell | 472/90 |
| 2,924,455 | A | * | 2/1960 | Brunel | 472/90 |
| 3,406,617 | A | * | 10/1968 | Randazzo | 472/90 |
| 3,443,493 | A | * | 5/1969 | Piano et al. | 472/90 |
| 3,570,846 | A | * | 3/1971 | Schweizer | 472/90 |
| 3,959,542 | A | | 5/1976 | Livermore | |
| 4,179,539 | A | * | 12/1979 | Schweizer | 428/58 |
| 5,647,804 | A | * | 7/1997 | Homma et al. | 472/90 |

* cited by examiner

*Primary Examiner*—Kien Nguyen
(74) *Attorney, Agent, or Firm*—Hooker & Habib, P.C.

(57) ABSTRACT

An artificial snow skiing surface has a number of spaced-apart rigid projections extending from a base. The surface is formed by joining like tile members that attach at side-by-side and end-to-end joints to form the mat. The joints and inherent flexibility of the tiles enable the mat to conform to irregular or non-planar substrates.

20 Claims, 6 Drawing Sheets

SKI MAT AND TILE MEMBER FOR FORMING THE SKI MAT

FIELD OF THE INVENTION

The invention relates to an artificial snow-skiing surface, and particularly to a tile member for joining with like tile members for forming the surface.

BACKGROUND OF THE INVENTION

Snow skiing, including free-form snow skiing and snowboarding, are very popular. In addition to traditional flat, downhill ski slopes, half pipes and terrain parks have become popular with skiing enthusiasts.

Many skiing enthusiasts would like to ski year-round. But most skiers cannot afford to travel during the summer months to reach skiing facilities thousands of miles away.

Artificial snow skiing surfaces have been developed to enable skiing during the summer months. One such conventional snow skiing surface has an appearance similar to a shag carpet. The carpet is laid out and skiers ski on top of the carpet. The carpet must be kept wet for skiing to reduce friction between the carpet and the skis to enable skiing. Even when the carpet is wet, however, friction generates high drag on skis or snowboards, impairing the skiing experience.

Thus there is a need for an improved artificial snow skiing surface for slopes, half pipes, and terrain parks. The improved surface should be inexpensive and easy to assemble, and provide a realistic snow skiing experience without being wet.

SUMMARY OF THE INVENTION

The invention is an improved artificial snow skiing surface for slopes, half pipes, and terrain parks. The improved surface is inexpensive and easy to assemble, and provides a realistic snow skiing experience without being wet.

An artificial snow skiing surface in accordance with the present invention is formed as a mat placed on a substrate (such as the ground or the walls defining a half pipe) to form an artificial skiing surface. The mat includes a base comprising upper and lower sides. A number of rigid, spaced-apart projections extend from the upper side of the base and away from the base to free end portions for bearing against skis or snowboards. The projections are spaced sufficiently close together so that a number of end portions simultaneously engage and support a ski or snowboard on the upper surface of the mat to provide an artificial snow skiing surface.

In preferred embodiments of the invention, the skiing mat is formed from a number of like tile members that join together to form the skiing surface.

Each tile member is preferably made using a nylon resin for inherently low friction without the need for wetting the surface for use. The tile member is manufactured by injection molding for high volume production at low per-tile cost.

The tile members preferably join together using a hook-and-rail structure that permits the sides and ends of adjacent tiles to rotate relative to each other. This enables the tiles to cover a non-planar surface, such as the transition walls of a half-pipe or moguls on a ski slope.

An artificial skiing surface formed with the tile members of the present invention is easily assembled on the ground or other substrate. Tiles can be pre-assembled into easily handled four-foot by eight-foot sheets to reduce on-site assembly.

Other objects and features of the present invention will become apparent as the description proceeds, especially when taken in conjunction with the accompanying six drawing sheets illustrating two embodiments of the invention.

DESCRIPTION OF THE PREFERRED EMBODIMENTS

Figure 1:
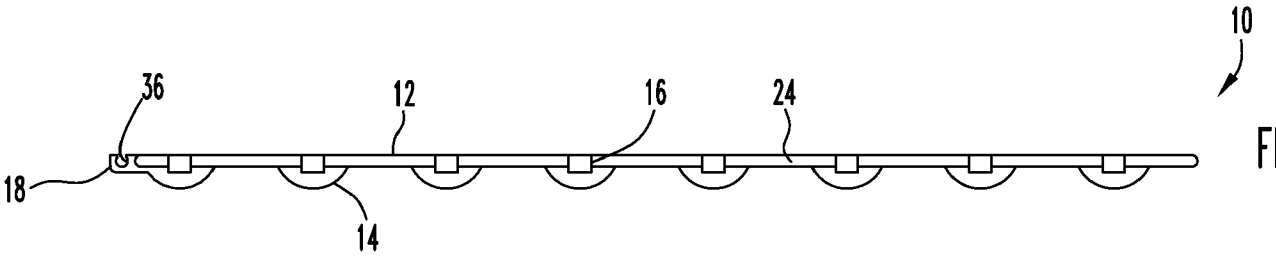
FIG. 1 is a top view of a first embodiment tile member for forming the ski mat of the present invention.
Figure 2:
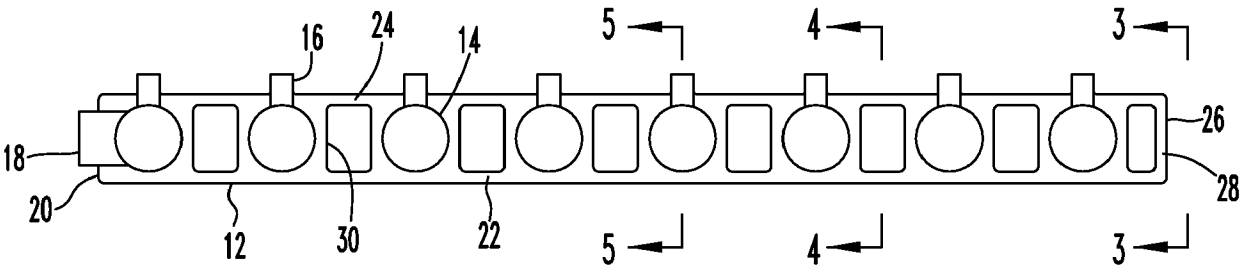
FIG. 2 is a front view of the tile member.
Figure 5:
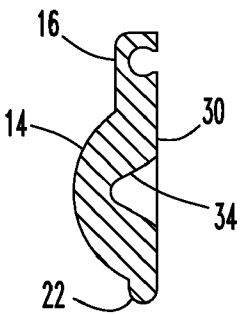
FIG. 5 is a second sectional view of the tile member taken along line 5-5 of FIG. 2.

FIGS. 1-5 illustrate a first embodiment tile member 10 for forming a ski mat or artificial snow skiing surface in accordance with the present invention. Member 10 is an elongate body having a base 12 and a number of spaced apart projections 14 extending away from the base. The projections 14 form part of the skiing surface as will be explained in greater detail below. Side hooks 16 are spaced along the base 12 for side-by-side attachment to an adjacent tile. An end hook 18 is located at one end 20 of the tile for end-to-end attachment to an adjacent tile.

Figure 4:
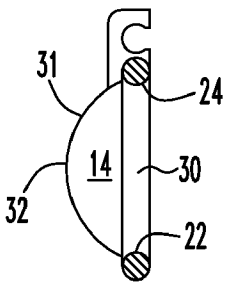
FIG. 4 is a first sectional view of the tile member taken along line 4-4 of FIG. 2.
Figure 3:
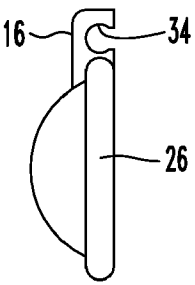
FIG. 3 is an end view of the tile member taken along line 3-3 of FIG. 2.

Base 12 includes two spaced apart, parallel longitudinal rails 22, 24 that extend along opposite sides of the base. As best seen in FIG. 4, each rail 22, 24 has a circular cross section. An end rail 26 located at the other end 28 of the base extends between the two rails 22, 24 and has a circular cross section identical to rails 22, 24. A number of spaced-apart rungs 30 also extend between the rails 22, 24. Member 10 is open between the rungs 30. The rung adjacent base end 28 is spaced from end rail 26. The rung adjacent base end 26 is located at that end of the base. Each rung 30 has a thickness equal to the rail diameter.

Projections 14 extend from the upper sides of rungs 30, with each projection 14 extending from a respective rung 30. The projections 14 are shaped like a portion of a hemisphere with the base of the projection on the rung 30 and a convex outer surface 31 extending to an upper end or upper surface 32.

Each side hook 16 is formed on the upper side of a rung 30 and extends from the projection 14 outwardly to a free end spaced outwardly away from side rail 24. A throat 34 is formed in hook 16 to capture and retain the side rail of the adjacent tile member. Endhook 18 is formed on the upper side of the rung adjacent base end 26 and extends from projection 14 outwardly to a free spaced outwardly away from base end 20. Endhook 18 includes a throat 36 to capture and retain the end rail of an adjacent tile member.

Illustrated tile member 10 is about twelve inches long and one inch wide. The base 12 is approximately one-eighth inch thick, and each of the eight projections 14 extends about a quarter-inch above the base.

Tile 10 is preferably made as a homogeneous, integral, one-piece member by injection molding using a polyamide (nylon) resin. A suitable resin is Material 2150T3U2 Wt-103 available from Technical Polymers, Buford, Ga. This is a polyamide resin having friction-reducing additives. The molded tile 10 has good toughness, low friction, and does not plastically compress under load when used as a ski mat. A conical hole 34 is molded into each rung and projection to improve cooling of the molded part and reduce material costs.

Figure 6:
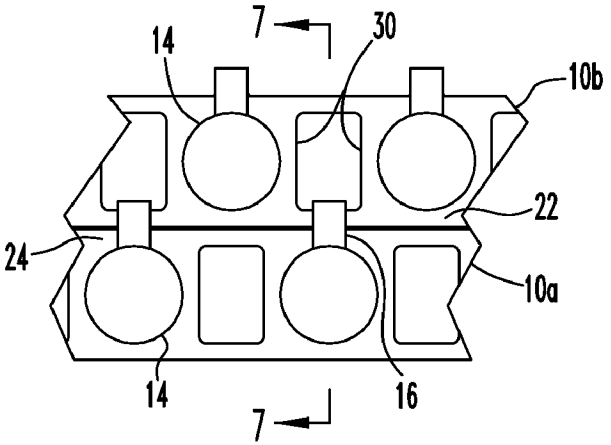
FIG. 6 is a partial front view of the tile member shown in FIG. 1 attached side-by-side to a second tile member.
Figure 7:
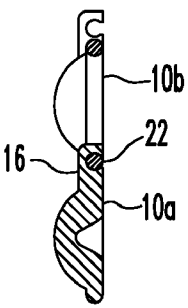
FIG. 7 is a sectional view of the tile members shown in FIG. 6 taken along line 7-7 of FIG. 6.

FIGS. 6 and 7 illustrate portions of two like tiles 10*a*, 10*b* attached side-by-side to one another for forming a ski mat. Rail 24 of tile 10*a* is adjacent rail 22 of tile 10*b*, with the projections 14 on the same side of the mat. Side hooks 16 of tile 10*a* are between the rungs 30 of tile 10*b*. Side rail 22 is snapped into hooks 16 as shown in FIG. 7 to connect the two tiles.

Figure 8:
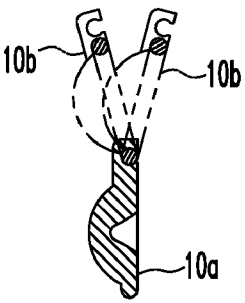
FIG. 8 is a view similar to FIG. 7 illustrating pivoting of one tile member relative to the other tile member.

Rail 22 can rotate within the hooks 16 to form pivot joints between tiles 10*a*, 10*b* that permit pivoting of tile 10*b* with respect to tile 10*a* about rail 22. FIG. 8 illustrates tile 10*b* in phantom in two different pivot positions.

Figure 9:
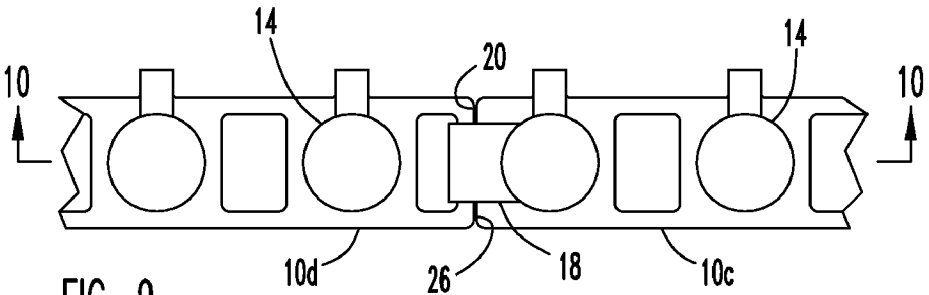
FIG. 9 is a partial front view of the tile member shown in FIG. 1 attached end-to-end to a second tile member.
Figure 10:
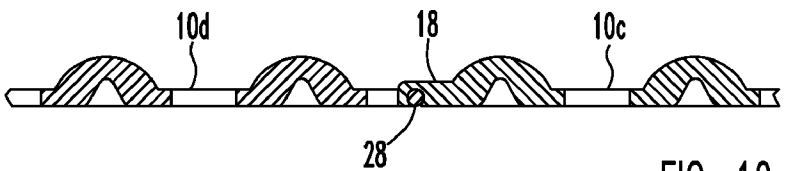
FIG. 10 is a sectional view of the tile members shown in FIG. 9 taken along line 10-10 of FIG. 9.
Figure 11:
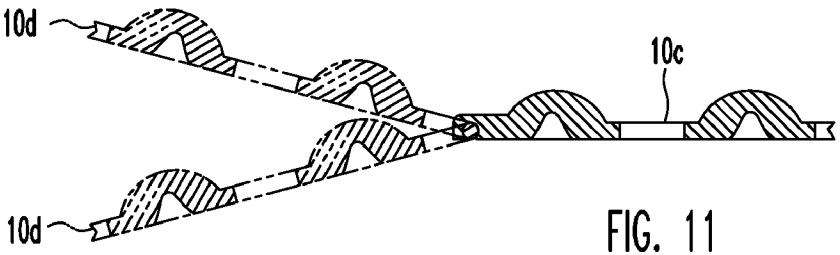
FIG. 11 is a view similar to FIG. 10 illustrating pivoting of one tile member relative to the other tile member.

FIGS. 9 and 10 illustrate two like tiles 10*c*, 10*d* attached end-to-end to one another for forming a ski mat. End 20 of tile 10*c* is adjacent end 26 of tile 10*d*, with the projections 14 on the same side of the mat. End hook 18 of tile 10*c* is centered over end rail 28 of tile 10*d*. End rail 28 is snapped into the throat of end hook 18 as shown in FIG. 10 to connect the two tiles.

Rail 28 can rotate within hook 18 to form a pivot joint that permits pivoting of tile 10*c* with respect to tile 10*d* about rail 28. FIG. 10 illustrates tile 10*d* in phantom in two different pivot positions.

Figure 12:
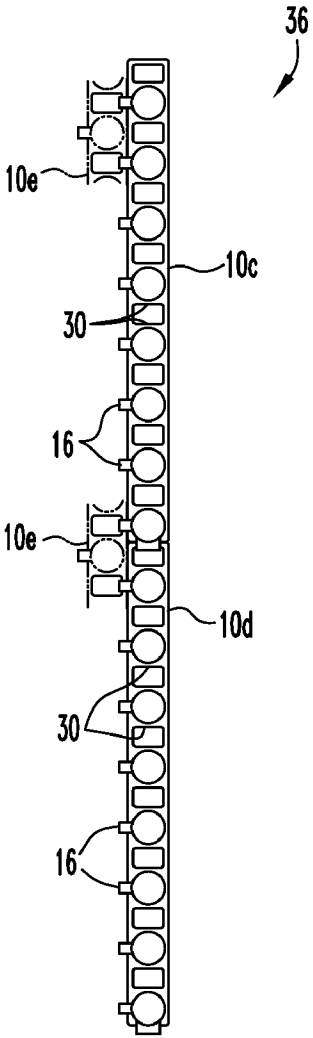
FIG. 12 is a view similar to FIG. 9 showing the two tiles full length and side-by-side attachment of a third tile at two alternative locations along the two tiles.

FIG. 12 illustrates the assembly 36 formed by joining tiles 10*c* and 10*d* end-to-end. The side hooks 16 and rungs 30 are uniformly spaced along the length of the assembly. This enables another tile 10 to attach to the side of the assembly anywhere along the length of the assembly. FIG. 12 illustrates in phantom a portion of a tile 10*e* attached to the side of assembly 36 at two different locations. As shown in the figure, tile 10*e* can span the joint between tiles 10*c*, 10*d*.

Figure 13:
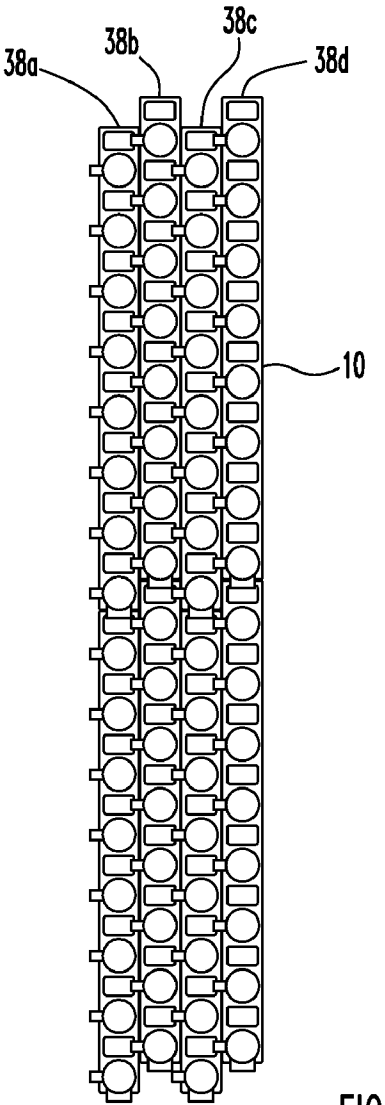
FIG. 13 is a front view of six tile members assembled together to form a portion of the ski mat.

Tiles 10 are attached end-to-end and side-by-side to form a ski mat of the desired size to cover the substrate. FIG. 13 illustrates eight tiles 10 connected as four rows 38*a*-38*d* of two tiles joined end to end. Tiles are joined side-by-side with the side hook nearest the end rail of one rail attached between the rung and end rail of the adjacent tile. Other attachment patterns can be used to stagger joints differently if desired. The ability of adjacent tiles to pivot relative to one another along their sides and ends, and the inherent flexibility of the tiles themselves enables the ski mat formed from the tiles to closely conform to curves, changes in slope or curvature, or other surface irregularities.

Figure 14:
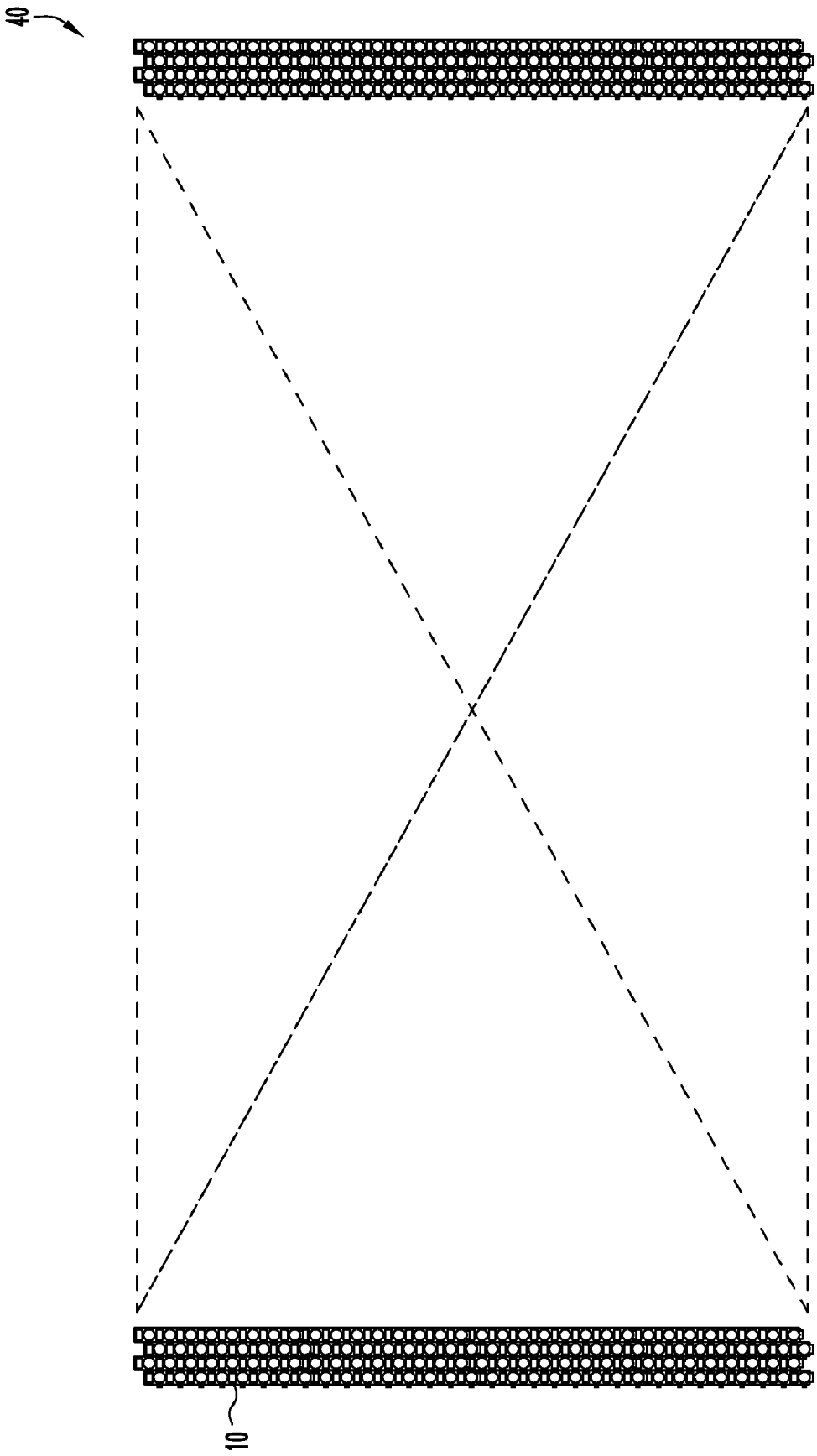
FIG. 14 is a front view of tile members assembled to form a larger portion of the ski mat.

The tiles shown in FIG. 13 cover an area of about four feet by four inches. FIG. 14 illustrates a preassembled mat 40 formed from tiles 10. Mat 40 is about four feet wide and eight feet long, and can be rolled up for storage. A number of mats 40 are made up prior to installation, transported to the job site, and then unrolled for use. Adjoining mats 40 are connected end-to-end and side-by-side as described above to cover the entire ski surface.

Figure 15:
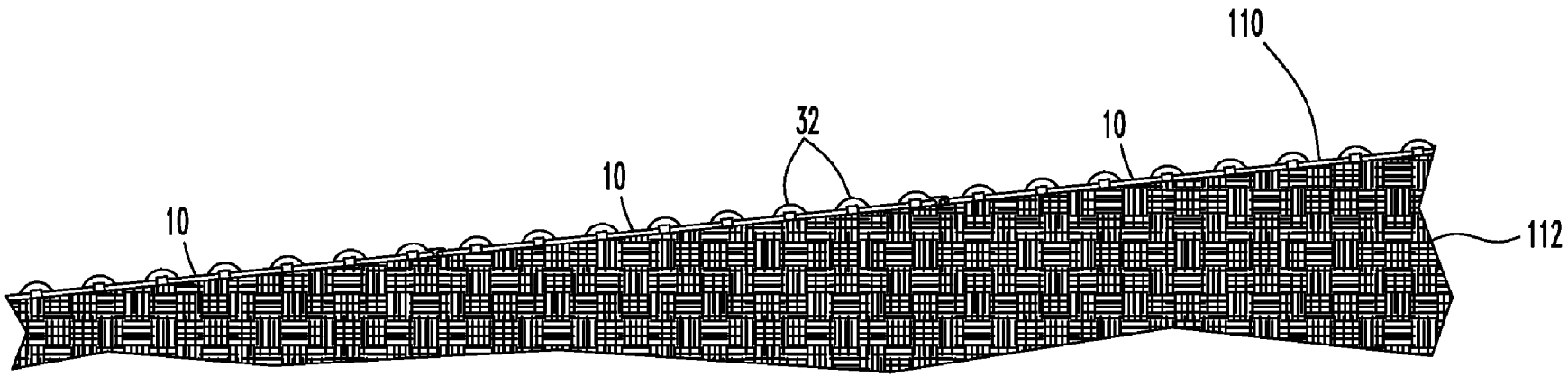
FIG. 15 illustrates a portion of the ski mat forming a skiing surface for a uniform downhill grade.

FIG. 15 illustrates a ski mat 110 formed from a number of like tiles 10. Mat 110 is placed or assembled directly on the ground or other substrate 112, such as plywood with projection surfaces 32 forming the upper surface of the mat. The mat can be kept in place by friction between the base of the tiles 10 as shown, or mechanical fasteners, such as adhesives or U-shaped nails/staples can mechanically fasten the rails 22, 24 to the substrate. The openings in tiles 10 between rungs 30 enable rainwater to quickly drain off the mat.

Figure 16:
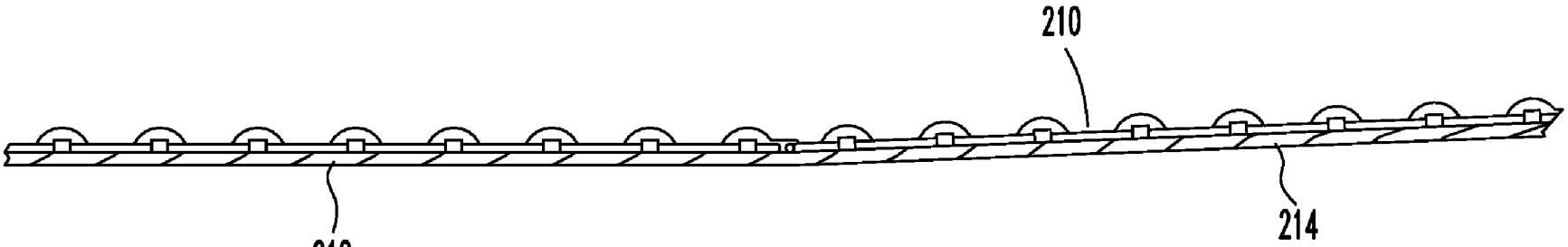
FIG. 16 illustrates a portion of the ski mat forming a skiing surface for a half-pipe.

FIG. 16 illustrates ski mat 210 like mat 110 covering a portion of the floor 212 and transition wall 214 of a half pipe. Tiles 10 can be mechanically fastened or glued to the substrate of the half pipe.

When skiing on a ski mat 110 or 210 formed from interconnected tiles 10, the skis, snowboard, toboggan or the like simultaneously bears against a number of the surfaces 32 forming the upper surface of the mat. The surfaces 32 are sufficiently close together to provide practically uniform support of the ski, snowboard, toboggan, or the like. The surfaces 32 are essentially point surfaces, so parasitic drag is reduced. The user experiences downhill performance very similar to that experienced on snow. In addition, the edges of skis or snowboards can push against the sides 31 of the projections 14 for making turns or other changes in direction.

Ski mats 110, 210 are formed from like tiles 10. In other embodiments the tiles forming the mat can be different sizes. For example, shorter-length tiles can be used to cover moguls or sharper discontinues. The denser joint spacings may make it easier to conform portions of the mat to the substrate than when using a uniform tiling.

Figure 17:
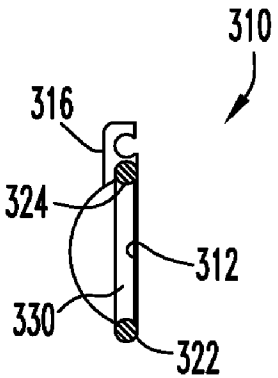
FIG. 17 is a sectional view similar to FIG. 4 of a second embodiment tile member.

FIG. 17 illustrates a second embodiment tile 310. Tile 310 is similar to tile 10 so only differences will be discussed. Webs 312 are formed between the rungs 330 and extend between the side rails 322, 324 along the bottom of the base. The webs 312 close the gaps between rungs 330 to provide additional fastening surfaces to attach the tiles to a substrate. Openings or perforations can be formed in webs 312 for water drainage. The outer end of side hooks 316 and the end hook extend to just above the plane of the webs.

Illustrated tiles 10, 310 are rectangularly shaped to permit a regular, periodic arrangement of tiles to cover a substrate. Other periodic tiling shapes are known and can be adapted for use with the present invention. The size, number, spacing, and shape of projections carried by the tile can also vary in other embodiments. Other connecting structures can be used instead of hooks and rails.

In yet other embodiments a ski mat in accordance with the present invention can be formed as a one-piece, integral unit.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. A tile member for joining with a plurality of like tile members to cooperatively form an artificial surface for skiing, snowboarding, and the like, the tile member comprising:

a base and a plurality of rigid projections extending from one side of the base, the projections spaced apart from one another, each projection extending to a free end spaced away from the base, and means for attaching a tile member to an adjacent tile member for forming the skiing surface;

the base comprising a first rail, a second rail, and a third rail, the first and second rails on opposite first and second sides of the base and extending between first and second ends of the base, the third rail located on the first end of the base and extending between the first and second sides of the base; and the means for attaching comprising at least one first hook and at least one second hook, the at least one first hook extending outwardly beyond the second side of the base and configured to capture an adjacent first rail of a like tile member adjacent the second side of the tile member, the at least one second hook extending beyond the second end of the base and configured to capture the third rail of a like tile member adjacent the second end of the tile member.

2. The tile member of claim 1 wherein the base comprises a plurality of spaced-apart rungs extending between the first and second rails, each projection extending from a respective rung.

3. The tile member of claim 2 wherein an open gap extends between each pair of neighboring rungs.

4. The tile member of claim 1 wherein the at least one first hook comprises a plurality of first hooks, each first hook extending from a respective projection, and the at least one second hook extends from the projection adjacent the second end of the base.

5. The tile member of claim 1 wherein each of the first, second, and third rails is a cylindrical member having a constant cross-section along its length.

6. A mat for forming an artificial surface for skiing, snowboarding, and the like, the mat comprising:

a plurality of like tile members, each tile member comprising:

(a) first and second rails on opposite sides of the tile member, each rail extending along its side of the tile member, the second rail being an elongate cylindrical member, the rails parallel with one another and defining a horizontal plane and a vertical direction perpendicular to the horizontal plane;

(b) a plurality of projections between the rails, the projections extending vertically to an upper surface spaced above the rails, the upper surfaces spaced apart from each other and all located on an upper side of the tile member to define a portion of the artificial surface; and (c) one or more first hooks spaced apart along the length of the first rail, each first hook extending away from the first and second rails to a throat sized to closely receive the second rail of a tile member;

wherein the plurality of tile members are interconnected side-by-side with one another by capturing the second rail of one tile member in the throat or throats of the one or more first hooks of a neighboring tile member.

7. The mat of claim 6 wherein the throat of each first hook is configured to cooperatively form a pivotable connection with a second rail when the second rail is captured by the first hook.

8. The mat of claim 6 wherein each tile member comprises a gap between each pair of neighboring projections, and the first hooks of the tile members interconnected side-by-side with other tile members extends into the gaps of the other tile members.

9. The mat of claim 8 wherein each tile member comprises a plurality of first hooks, the first hooks and the projections having the same spacing along the length of the first rail.

10. The mat of claim 6 wherein the first and second rails of each tile member extend between opposite ends of the tile member, and the ends of each tile member connected side-by side with another tile member are staggered from the ends of such other tile member.

11. The mat of claim 6 wherein:

each tile member comprises a third rail and a fourth rail located on opposite ends of the tile member, the first and second rails extending between the third and fourth rails, and one or more second hooks spaced along the third rail, each second hook extending away from the third and fourth rails to a throat sized to closely receive the fourth rail of a tile member; and the mat comprises tile members additionally interconnected end-to-end with one another by capturing the fourth rail of one tile member in the throat or throats of the one or more second hooks of an adjacent tile member.

12. The mat of claim 11 wherein the throat of each second hook is sized to cooperatively form a pivotable connection with a fourth rail of an adjacent tile member when the fourth rail is captured by the second hook.

13. A mat for forming an artificial surface for skiing, snowboarding, and the like, the mat comprising:

a plurality of like tile members, each tile member comprising:

first and second rails on opposite first and second sides of the tile member, a plurality of projections between the rails, and one or more hooks, the rails parallel with one another and defining a horizontal plane and a vertical direction perpendicular to the horizontal plane, each rail extending along a length on its side of the tile member, the projections extending vertically to an upper surface spaced above the rails, the upper surfaces spaced apart from each other and all located on an upper side of the tile member to define a portion of the artificial surface, the first rail comprising like portions spaced apart along the length of the first rail, each portion of the first rail having a uniform cylindrical cross section along the length of such portion, the at least one hooks extending outwardly away from the second rail, each hook comprising a throat sized to closely receive a first rail portion; and the plurality of tile members interconnected side-by-side with one another by capturing the first rail portions of one tile member in the one or more throats of the one or more hooks of neighboring tile members.

14. The mat of claim 13 wherein each first rail portion has a circular cross-section.

15. The mat of claim 13 wherein the hooks and the first rail portions are configured to form a pivotable connection therebetween when a first rail portion is received in the throat of a hook.

16. The mat of claim 13 wherein each tile member comprises third and fourth rails on opposite ends of the tile member, and the ski mat comprises tile members additionally interconnected end-to-end to one another by interconnecting adjacent third and fourth rails of the tile members.

17. The mat of claim 16 wherein each tile member comprises a cylindrical fourth rail and at least one additional hook extending outwardly away from the third rail, each additional hook having a throat closely receiving a fourth rail of an adjacent tile member to interconnect end-to-end adjacent tile members.

18. The mat of claim 17 wherein the fourth rail of each tile member has a solid circular cross section.

19. The mat of claim 13 wherein each tile member comprises rungs spaced apart along the length of the first and second rails and extending between the first and second rails, the projections on the rungs.

20. The mat of claim 19 wherein each tile member comprises open gaps between adjacent rungs.

* * * * *